United States Patent [19]

Suguro et al.

[11] Patent Number: 4,542,394

[45] Date of Patent: Sep. 17, 1985

[54] DIAZO-TYPE THERMOSENSITIVE RECORDING MATERIAL

[75] Inventors: Yoshihiro Suguro, Mishima; Masanaka Nagamoto, Shizuoka, both of Japan

[73] Assignee: Ricoh Company, Ltd., Tokyo, Japan

[21] Appl. No.: 595,023

[22] Filed: Mar. 30, 1984

[30] Foreign Application Priority Data

Apr. 6, 1983 [JP] Japan ..... 58-60501

[51] Int. Cl.[4] ..... B41M 5/18

[52] U.S. Cl. ..... 346/209; 346/208; 346/217; 346/218; 427/150; 427/151

[58] Field of Search ..... 346/200, 208, 209, 217, 346/218, 226; 427/150, 151, 152, 153

[56] References Cited

FOREIGN PATENT DOCUMENTS 0051190 3/1983 Japan ..... 346/214

*Primary Examiner*—Bruce H. Hess

*Attorney, Agent, or Firm*—Flynn, Thiel, Boutell & Tanis

[57] ABSTRACT

A diazo-type thermosensitive recording material is disclosed, which comprises a support material, and at least two layers formed thereon, one of the layers being a diazonium compound layer comprising at least a diazonium compound, and another of the layers being a coupler layer comprising at least a coupler capable of reacting with the diazonium compound to form a dye, and a benzimidazole derivative having a substituent at the 1-position thereof.

6 Claims, No Drawings

DIAZO-TYPE THERMOSENSITIVE RECORDING MATERIAL

BACKGROUND OF THE INVENTION

The present invention relates to a thermosensitive recording material, in particular, to a thermosensitive recording material with photo-fixing ability. More precisely, the present invention relates to a diazo-type thermosensitive recording material which colors in response to recording by thermal heads at a certain temperature; which loses coloring ability in the non-recorded areas upon photo-irradiation; and which cannot thereafter be further colored even if heated again.

Thermosensitive recording materials are being used not only for copying material from books and documents, but also as output recording sheets for computers, facsimile apparatus and medical analytical instruments, as well as for thermosensitive-recording-type magnetic tickets and thermosensitive-recording-type labels. Because of the ease of automatic recording, thermosensitive recording materials can also be utilized for securities, merchandise coupons, entrance tickets, certificates, payment slips and the like. However, thermosensitive recording materials for such uses must be image-fixable in order to maintain the integrity of the recorded information.

Conventionally, as an image-fixable thermosensitive recording material, a diazo-type thermosensitive recording material is known, which utilizes the coloring reaction between a diazonium compound and a coupler. However, the conventional diazo-type thermosensitive recording material cannot be used in practice because of its slow thermal response to a thermal head and poor preservability. Especially in the field of facsimiles, a thermosensitive-recording material with rapid recording (rapid coloring) is required in order to minimize communication costs. This conventional diazo-type material does not satisfactorily meet such a requirement. Therefore, it is necessary to improve the diazo photosensitive paper so as to cause the coloring reaction to occur efficiently by minimum energy consumption.

In another conventional diazo photosensitive paper, the coloring reaction can be caused to occur so as to provide sufficiently high image density by use of ammonium water or an alkaline solution as a developer, or by sufficient heat application, so long as it is used in a conventional manner with a conventional slow development speed.

Under such circumstances, there have been proposed improved thermosensitive recording materials, which utilize the coloring reaction between a diazonium compound and a coupler.

For instance, in a reference entitled "Light Sensitive System" by J. Kosar (published by John and Wiley and Sons in 1965), there is proposed a thermosensitive recording material utilizing a basic material in its coloring system, for instance, inorganic ammonium salts, organic ammonium salts, and organic amines such as urea, thiourea, guanidine and biuret, in order to place the coloring system in an alkaline atmosphere for accelerating the thermal development.

In Japanese Patent Publication No. 57-19407, there are disclosed thermal reactive diazo-type recording sheets in which as a basic material for neutralizing an acid, imidazole or imidazoline derivatives are employed. These additives, however, have the shortcomings of decreasing the development performance after a prolonged storage of the recording materials, due to the sublimation properties thereof. Except for the recording material utilizing imidazole, the above-mentioned recording materials do not yield sufficiently high image density, and yet again, those conventional diazo-type materials do not satisfactorily meet the requirements for use with a thermal head or pen.

Further, in Japanese Patent Publication No. 53-27604, there is disclosed a diazo-type thermosensitive recording sheet in which benzimidazole derivatives, which are less basic than imidazole, are employed. This diazo-type thermosensitive recording sheet does not yield sufficiently high image density, either.

SUMMARY OF THE INVENTION

It is therefore an object of the present invention to provide a diazo-type thermosensitive recording material which is improved with respect to preservability and thermal response, and is capable of providing high image density at high speed with minimum energy consumption, for instance, by use of a thermal head or thermal pen, by utilizing basic materials which, unlike the conventional basic materials, serve to increase the developed image density, without impairing the preservability of the diazo-type thermosensitive recording material.

According to the present invention, this object of the present invention is attained by a diazo-type thermosensitive recording material comprising a support material, a thermosensitive coloring layer formed thereon, which thermosensitive coloring layer comprises a diazonium compound layer containing as the main component a diazonium compound, and a coupler layer containing as the main component a coupler capable of reacting with the diazonium compound to form a dye, and a 1-substituted benzimidazole derivative, in which diazo-type thermosensitive recording material, the diazonium compound layer and the coupler layer can be formed in any order.

DETAILED DESCRIPTION OF THE PREFERRED EMBODIMENTS

Generally, benzimidazole derivatives do not react with diazonium compounds and are slightly soluble in water, so that benzimidazole derivatives are stable to humidity. Therefore, when benzimidazole derivatives are contained as additives in a diazo-type thermosensitive recording material, they do not deteriorate the recording material before it is subjected to exposure and image fixing for recording.

Further, as mentioned above, in the diazo-type thermosensitive recording material according to the present invention, since the diazonium compound layer and the coupler layer are separately formed and overlayed, the preservability of the thermosensitive recording material is more improved and guaranteed as compared with the conventional diazo-type thermosensitive recording material.

The melting points of 1-substituted benzimidazole derivatives for use in the present invention are lower than the melting points of the conventionally employed benzimidazole derivatives having hydrogen at the 1-position, that is, without any other substituent at the 1-position, and the 1-substituted benzimidazole derivatives are more miscible with couplers than 1-non-substituted benzimidazole derivatives. Therefore, the diazo-type thermosensitive recording material according to the present invention, utilizing the 1-substituted benzimidazole derivatives, has a higher coupling rate at low temperatures, as compared with the conventional diazo-type thermosensitive recording materials, and is capable of providing sufficiently high image density at high speed with minimum energy consumption, for instance, by use of a thermal head or pen.

The 1-substituted benzimidazole derivatives for use in the present invention themselves are known compounds and commercially available, and can be synthesized without difficulty under a conventional procedure.

The substituents at the 1-position of the benzimidazole derivatives are, for example, an alkyl group, an aryl group, an aralkyl group, halogen, a cyano group, an acyl group, an amino group, a monoalkylamino group, a dialkylamino group, an anilino group, a monoalkylanilino group or a dialkylanilino group.

Specific examples of the 1-substituted benzimidazole derivatives for use in the present invention are as follows:

| | Melting Point (°C.) |
|---|---|
| 1-methylbenzimidazole | 66 |
| 1-phenylbenzimidazole | 98 |
| 1-benzylbenzimidazole | 115 |
| 1,2-dimethylbenzimidazole | 112 |
| 1-p-tolyl-benzimidazole | 160 |
| 1-benzoylbenzimidazole | 91–92 |
| 1-methyl-4,5,7-trichlorobenzimidazole | 159–160 |
| 1-phenyl-6-bromobenzimidazole | 110 |
| 1-ethyl-2-methylbenzimidazole | 160 |
| 1,2-dimethyl-4,5,7-trichlorobenzimidazole | 120–121 |
| 1-phenyl-2-methyl-6-chlorobenzimidazole | 96 |
| 1-ethyl-2-methyl-4,5,7-trichlorobenzimidazole | 116 |
| 1-ethyl-4,5,6,7-tetrachlorobenzimidazole | 149 |
| 1-propyl-2-ethylbenzimidazole | 128–129 |
| 1,5-dimethylbenzimidazole | 94.5–95 |
| 1-ethyl-2,5-dimethylbenzimidazole | 86–87 |
| 1-p-tolyl-2,5-dimethylbenzimidazole | 94–95 |
| 1-benzyl-2,5-dimethylbenzimidazole | 144 |
| 1-chloro-2,5-dimethylbenzimidazole | 92 |
| 1,4,6-trimethylbenzimidazole | 70 |
| 1-p-toluidino-2-ethyl-6-methylbenzimidazole | 96 |
| 1-methyl-2-phenylbenzimidazole | 170–171 |
| 1-ethyl-2-phenylbenzimidazole | 80–81 |
| 1,2-diphenylbenzimidazole | 112 |
| 1-benzyl-2-phenylbenzimidazole | 133–134 |
| 1-cyano-2-phenylbenzimidazole | 105.5 |
| 1-methyl-2-phenyl-5-nitrobenzimidazole | 140 |
| 1-p-tolyl-2-phenyl-5-methylbenzimidazole | 165–166 |
| 1,5-dimethyl-2-phenylbenzimidazole | 126–127 |

These 1-substituted benzimidazole derivatives can be used alone or in combination.

In the present invention, conventional diazonium compounds and couplers for use in the conventional diazo-type recording materials can be employed.

Examples of the diazonium compounds for use in the present invention are as follows:

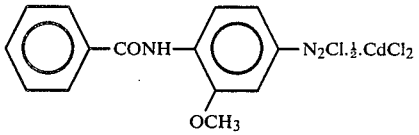

-continued

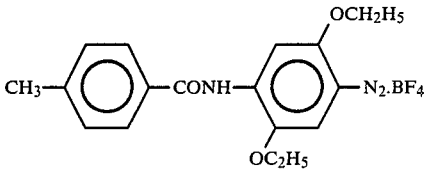

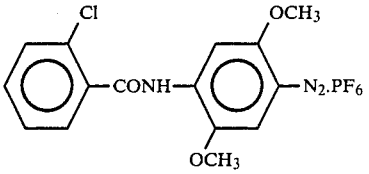

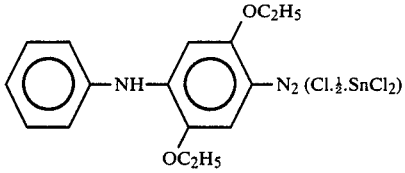

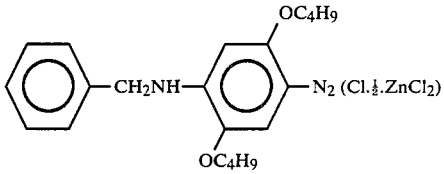

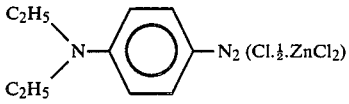

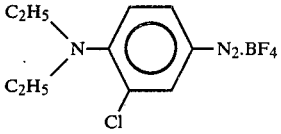

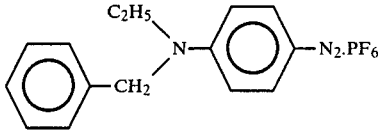

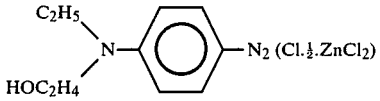

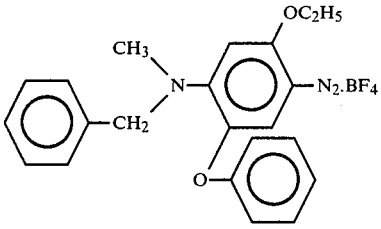

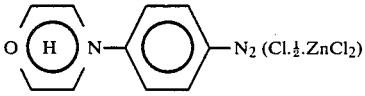

-continued

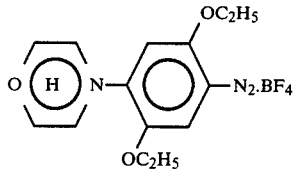

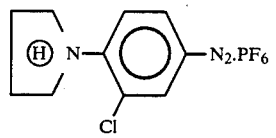

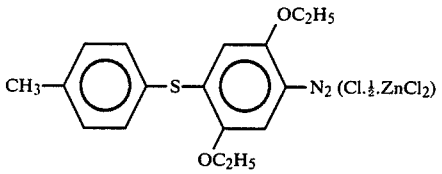

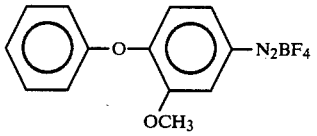

In the present invention, in order to obtain thermosensitive recording materials with excellent preservability, it is preferable to employ the diazonium compounds in the form of water-insoluble salts, for example, the salts of fluorine-containing acids, for instance, in the form containing a moiety of —$BF_4$ or —$PF_6$.

Examples of the couplers for use in the present invention are as follows:

(1) Phenol derivatives such as phenol, resorcinol, methylresorcinol, 2,2',4,4'-tetrahydroxydiphenyl, phloroglucinol, resorcylic acid, phloroglucinolcarboxylic acid, 2-methyl-5-methoxy-1,3-dihydroxybenzene, 5-methoxy-1,3-dihydroxybenzene, 4-N,N-dimethyl-p-aminophenol, 2,6-dimethyl-1,3,5-trihydroxybenzene, 2,6-dihydroxy-benzoic acid and 2,6-dihydroxy-3,5-dibromo-4-methoxy benzoic acid.

(2) Naphthol derivatives such as $\alpha$-naphthol, $\beta$-naphthol, 4-methoxy-1-naphthol, 2,3-dihydroxynaphthalene, 2,3-dihydroxynaphthalene-6-sodium sulfonate, 2-hydroxy-3-propylmorpholino-naphthoic acid, 2-hydroxy-3-naphtho-o-toluidide, 2-hydroxy-3-naphthoic acid morpholinopropylamide, and Naphthol AS.

(3) Active methylene compounds such as acetanilide, 4-benzoylamino-2,5-diethoxyacetanilide, N-acetoacetooctadecylamine, N,N'-bis(acetoaceto)decane-1,10-diamine, and 2,4,6-tribromoacetanilide.

The couplers for use in the present invention are not limited to the above. Any other materials which serve as a coupler for the previously described diazonium compounds can be employed. In the present invention, however, couplers which are slightly soluble or insoluble in water are preferable for attaining a prolonged preservability of the thermosensitive recording material.

The combinations of the above-mentioned diazonium compounds and couplers can be determined in accordance with the desired color tone.

For increasing the density of the developed image, it is preferable that the amount of the 1-substituted benzimidazole derivative be in the range of 0.1 to 5 parts by weight with respect to one part by weight of the coupler, more preferably in the range of 0.2 to 2.0 parts by weight with respect to one part by weight of the coupler.

To the above coloring components, thermo-fusible materials, fillers and binder agents can be added as additives when necessary.

By addition of thermo-fusible materials, the melting point of the thermosensitive coloring layer can be decreased, so that the thermal response of the recording material and the density of the developed images can be increased. However, if the melting point of the thermosensitive coloring layer is decreased too much by the addition of a thermo-fusible material, the thermosensitive coloring layer becomes sticky to a thermal head or pen when recording, and quick deterioration of the recording material is caused. On the other hand, when the melting point of the thermosensitive coloring layer is too high, high image density cannot be obtained. For attaining high speed coloring with high image density, it is preferable that the thermo-fusible materials for use in the present invention have a melting or softening point ranging from 50° C. to 250° C. A thermo-fusible material with a melting or softening point below 50° C. would cause poor long-term preservation in the thermosensitive recording material, while a thermo-fusible material having a melting or softening point above 250° C. would lead to insufficient thermal response to a thermal head for practical use.

Examples of the thermo-fusible materials for use in the present invention are as follows: alcohol derivatives such as 2,2,2-tribromoethanol, 2,2-dimethyl-trimethylene glycol and cyclohexane-1,2-diol; acid derivatives such as malonic acid, glutaric acid, maleic acid, and methylmaleic acid; animal waxes such as bees wax and shellac wax; plant waxes such as carnauba wax; mineral waxes such as montan wax; petroleum waxes such as paraffin wax and microcrystalline wax; and other synthetic waxes such as polyhydric alcohol esters of higher fatty acids, higher fatty amines, higher fatty amides, condensates of fatty acids and amines, condensates of aromatic acids and amines, synthetic paraffins, chlorinated paraffin, metal salts of high fatty acids, higher straight-chain glycols, dialkyl-3,4-epoxyhexahydrophthalate, and N-alkylcarbamoylbenzene.

In the present invention, fillers can be added to the thermosensitive coloring layer for improving the compatibility of the thermosensitive coloring layer with the thermal head which applies heat to the coloring layer for image formation. The following are examples of such fillers: organic and inorganic materials such as microparticles of styrene resin, microparticles of urea-formaldehyde condensate resin, aluminum hydroxide, magnesium hydroxide, calcium carbonate, titanium, talc, kaolin, silica and aluminium.

The above additives can be used alone or in combination when necessary.

A diazo-type thermosensitive recording material according to the present invention can be prepared, for example, as follows:

First, on a support material, which has been precoated when necessary, there is formed a diazonium compound layer by applying to the support material an aqueous or organic solvent solution or dispersion of a diazonium compound and an appropriate binder agent. Second, a coupler layer is formed on the diazonium compound layer by applying thereto an aqueous or organic solvent solution or dispersion of a coupler, one of the previously described 1-substituted benzimidazole derivatives and an appropriate binder agent. The formation of the diazonium compound layer and the coupler layer can be done under the conventional application procedure.

As the binder agent for use in the diazonium compound layer, a water-insoluble binder agent is employed. Examples of the water-insoluble binder agent are polyester, polystyrene, chlorinated rubber, polyvinyl acetate, polyvinyl chloride, polybutadiene, polyacrylic acid ester, vinyl chloride/vinyl acetate copolymer, polybutadiene, styrene/butadiene/acryl copolymer, polyethylene, ethylene/vinyl acetate copolymer, styrene/acryl copolymer, polyvinylidiene chloride, vinylidiene chloride/acryl copolymer, phenol resin, urea/formaldehyde resin and melamine resin. The above binder agents are organic-solvent-soluble or water-dispersible.

As the binder resins for use in the coupler layer, in addition to the above-described organic-solvent-soluble or water-dispersible resins, the following water-soluble resins can be employed: polyvinyl alcohol, polyacrylamide, casein, gelatin, starch and its derivatives, polyvinyl pyrrolidone, carboxymethylcellulose, methylcellulose, ethylcellulose, styrene/maleic anhydride copolymer, and iso(or di-iso)butylene/maleic anhydride copolymer.

As the support material for use in the present invention, paper, synthetic paper, plastic film or resin- or filler-coated base paper can be employed.

Embodiments of a diazo-type thermosensitive recording material according to the present invention will now be explained in detail by referring to the following examples:

EXAMPLE 1

(1) Preparation of Diazonium Compound Layer Formation Liquid D-1

| | Parts by Weight |
|---|---|
| 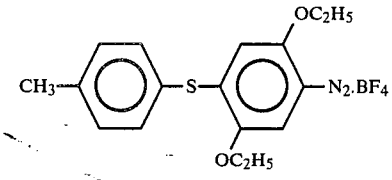 | 0.35 |
| Stearamide | 1.0 |
| Vinyl chloride/vinyl acetate copolymer | 2.0 |
| Methyl cellosolve | 30.65 |

The above components were mixed and ground in a ball mill for 24 hours, whereby a diazonium compound layer formation liquid D-1 was prepared.

(2) Preparation of Coupler Layer Formation Liquid C-1

| | Parts by Weight |
|---|---|
| 1-benzylbenzimidazole | 1.0 |
| Naphthol AS | 0.7 |
| Silica | 0.5 |
| Methylcellulose | 0.5 |
| Water | 19.3 |

The above components were mixed and ground in a ball mill for 24 hours, whereby a coupler layer formation liquid C-1 was prepared.

An aqueous dispersion containing 1.5 parts by weight of polyvinyl alcohol and 0.5 parts by weight of calcium carbonate was applied to a sheet of high quality paper (50 g/m$^2$) so as to form an undercoat layer thereon with a deposition of 2.0 g/m$^2$ of the solid components when dried.

After drying the undercoat layer, the above prepared diazonium compound layer formation liquid D-1 was applied to the undercoat-layer-coated paper to form a diazonium compound layer with a deposition of 3.35 g/m$^2$ of the solid components of the liquid D-1 when dried.

After drying the diazonium compound layer, the above prepared coupler layer formation liquid C-1 was applied to the diazonium compound layer to form a coupler layer on the diazonium compound layer with a deposition of 2.7 g/m$^2$ of the solid components of the liquid C-1 when dried, whereby a thermosensitive coloring layer was formed on the high quality paper.

The thus prepared thermosensitive recording material was subjected to drying and calendering so as to have a smoothness of 400 seconds in terms of Bekk's smoothness, whereby a diazo-type thermosensitive recording material No. 1 according to the present invention was prepared.

On this thermosensitive recording material, images were formed by a commercially available high speed facsimile apparatus (Rifax 300 made by Ricoh Company, Ltd.) under G-II mode. The images were then optically fixed by complete exposure to U.V. light using a commercially available diazo copying machine (Ricopy High-Start made by Ricoh Company, Ltd.), whereby clear blue images were obtained.

The image density of the thus obtained images and the background density were measured by a Macbeth densitometer (RD-514). The results were that the image density was 1.07 and the background density was 0.10.

After this image fixing, the thermosensitive recording material was subjected to a forced storage test in which the recording material was allowed to stand at 40° C. under relative humidity of 90% for 24 hours. After this forced storage test, the background density was 0.16.

EXAMPLE 2

(1) Preparation of Diazonium Compound Layer Formation Liquid D-2

| | Parts by Weight |
|---|---|
| 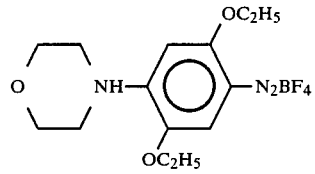 | 0.35 |
| Vinyl chloride/vinyl acetate copolymer | 2.0 |
| Methyl cellosolve | 31.65 |

The above components were mixed and ground in a ball mill for 24 hours, whereby a diazonium compound layer formation liquid D-2 was prepared.

(2) Preparation of Coupler Layer Formation Liquid C-2

| | Parts by Weight |
|---|---|
| 1-benzoylbenzimidazole | 1.0 |
| N—stearylbenzamide | 1.0 |
| Naphthol AS | 0.7 |
| Silica | 0.5 |
| Methylcellulose | 0.5 |
| Water | 18.3 |

The above components were mixed and ground in a ball mill for 24 hours, whereby a coupler layer formation liquid C-2 was prepared.

An aqueous dispersion containing 1.5 parts by weight of polyvinyl alcohol and 0.5 parts by weight of calcium carbonate was applied to a sheet of high quality paper (50 g/m$^2$) so as to form an undercoat layer thereon with a deposition of 2.0 g/m$^2$ of the solid components when dried.

After drying the undercoat layer, the above prepared diazonium compound layer formation liquid D-2 was applied to the undercoat-layer-coated paper to form a diazonium compound layer with a deposition of 2.35 g/m$^2$ of the solid components of the liquid D-2 when dried.

After drying the diazonium compound layer, the above prepared coupler layer formation liquid C-2 was applied to the diazonium compound layer to form a coupler layer on the diazonium compound layer with a deposition of 3.7 g/m$^2$ of the solid components of the liquid C-2 when dried, whereby a thermosensitive coloring layer was formed on the high quality paper.

The thus prepared thermosensitive recording material was subjected to drying and calendering as in Example 1 so as to have a smoothness of 400 seconds in terms of Bekk's smoothness, whereby a diazo-type thermosensitive recording material No. 2 according to the present invention was prepared.

On this thermosensitive recording material, images were formed and were then fixed in the same manner as in Example 1.

The image density of the thus obtained images and the background density were measured by the Macbeth densitometer (RD-514). The results were that the image density was 1.12 and the background density was 0.09.

After this image fixing, the thermosensitive recording material was subjected to the same forced storage test as in Example 1 in which the recording material was allowed to stand at 40° C. under relative humidity of 90% for 24 hours. After this forced test, the background density was 0.14.

EXAMPLE 3

(1) Preparation of Diazonium Compound Layer Formation Liquid D-3

| | Parts by Weight |
|---|---|
| 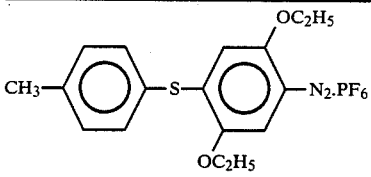 | 0.35 |
| Isobutylene/maleic anhydride copolymer | 2.0 |
| Water | 31.65 |

The above components were mixed and ground in a ball mill for 24 hours, whereby a diazonium compound layer formation liquid D-3 was prepared.

(2) Preparation of Coupler Layer Formation Liquid C-3

| | Parts by Weight |
|---|---|
| 1-chloro-2,5-dimethylbenzimidazole | 1.0 |
| N—stearylnaphtoamide | 1.0 |
| Naphthol AS | 0.7 |
| Silica | 0.5 |
| Isobutylene/maleic anhydride copolymer | 0.5 |
| Water | 18.3 |

The above components were mixed and ground in a ball mill for 24 hours, whereby a coupler layer formation liquid C-3 was prepared.

An aqueous dispersion containing 1.5 parts by weight of polyvinyl alcohol and 0.5 parts by weight of calcium carbonate was applied to a sheet of high quality paper (50 g/m$^2$) so as to form an undercoat layer thereon with a deposition of 2.0 g/m$^2$ of the solid components when dried.

After drying the undercoat layer, the above prepared diazonium compound layer formation liquid D-3 was applied to the undercoat-layer-coated paper to form a diazonium compound layer with a deposition of 2.35 g/m$^2$ of the solid components of the liquid D-3 when dried.

After drying the diazonium compound layer, the above prepared coupler layer formation liquid C-3 was applied to the diazonium compound layer to form a coupler layer on the diazonium compound layer with a deposition of 3.7 g/m$^2$ of the solid components of the liquid C-3 when dried, whereby a thermosensitive coloring layer was formed on the high quality paper.

The thus prepared thermosensitive recording material was subjected to drying and calendering as in Example 1 so as to have a smoothness of 400 seconds in terms of Bekk's smoothness, whereby a diazo-type thermosensitive recording material No. 3 according to the present invention was prepared.

On this thermosensitive recording material, images were formed and were then fixed in the same manner as in Example 1.

The image density of the thus obtained images and the background density were measured by the Macbeth densitometer (RD-514). The results were that the image density was 1.13 and the background density was 0.10.

After this image fixing, the thermosensitive recording material was subjected to the same forced storage test as in Example 1 in which the recording material was allowed to stand at 40° C. under relative humidity of 90% for 24 hours. After this forced test, the background density was 0.15.

EXAMPLE 4

(1) Preparation of Diazonium Compound Layer Formation Liquid D-4

| | Parts by Weight |
|---|---|
| 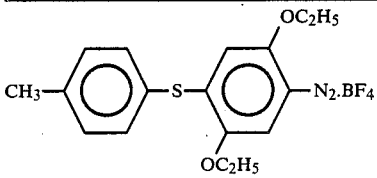 | 0.35 |
| N—cyclohexylstearamide | 0.5 |
| Vinyl chloride/vinyl acetate copolymer | 1.0 |
| Methyl cellosolve | 32.15 |

The above components were mixed and ground in a ball mill for 24 hours, whereby a diazonium compound layer formation liquid D-4 was prepared.

(2) Preparation of Coupler Layer Formation Liquid C-4

| | Parts by Weight |
|---|---|
| 1-phenylbenzimidazole | 1.0 |
| N—stearylbenzamide | 0.5 |
| Naphthol AS | 0.7 |
| Silica | 0.5 |
| Polyvinyl alcohol | 0.5 |
| Water | 18.8 |

The above components were mixed and ground in a ball mill for 24 hours, whereby a coupler layer formation liquid C-4 was prepared.

The above prepared diazonium compound layer formation liquid D-4 was applied to a polyester film with a thickness of 188 μm to form a diazonium compound layer with a deposition of 1.85 g/m$^2$ of the solid components of the liquid D-4 when dried.

After drying the diazonium compound layer, the above prepared coupler layer formation liquid C-4 was applied to the diazonium compound layer to form a coupler layer on the diazonium compound layer with a deposition of 3.2 g/m$^2$ of the solid components of the liquid C-4 when dried, whereby a thermosensitive coloring layer was formed on the polyester film.

The thus prepared thermosensitive recording material was subjected to drying and calendering as in Example 1 so as to have a smoothness of 400 seconds in terms of Bekk's smoothness, whereby a diazo-type thermosensitive recording material No. 4 according to the present invention was prepared.

On this thermosensitive recording material, images were formed and were then fixed in the same manner as in Example 1.

The image density of the thus obtained images and the background density were measured by the Macbeth densitometer (RD-514). The results were that the image density was 1.10 and the background density was 0.09.

After this image fixing, the thermosensitive recording material was subjected to the same forced storage test as in Example 1 in which the recording material was allowed to stand at 40° C. under relative humidity of 90% for 24 hours. After this forced test, the background density was 0.14.

EXAMPLE 5

(1) Preparation of Diazonium Compound Layer Formation Liquid D-5

| | Parts by Weight |
|---|---|
| 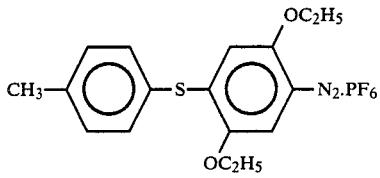 | 0.35 |
| Isobutylene/maleic anhydride copolymer | 2.0 |
| Water | 31.65 |

The above components were mixed and ground in a ball mill for 24 hours, whereby a diazonium compound layer formation liquid D-5, which was the same as the diazonium compound layer formation liquid D-3, was prepared.

(2) Preparation of Coupler Layer Formation Liquid C-5

| | Parts by Weight |
|---|---|
| 1,2-dimethylbenzimidazole | 1.0 |
| N—stearylnaphtoamide | 1.0 |
| Naphthol AS | 0.7 |
| Silica | 0.5 |
| Isobutylene/maleic anhydride copolymer | 0.5 |
| Water | 18.3 |

The above components were mixed and ground in a ball mill for 24 hours, whereby a coupler layer formation liquid C-5 was prepared.

An aqueous dispersion containing 1.5 parts by weight of polyvinyl alcohol and 0.5 parts by weight of calcium carbonate was applied to a sheet of high quality paper (50 g/m$^2$) so as to form an undercoat layer thereon with a deposition of 2.0 g/m$^2$ of the solid components when dried.

After drying the undercoat layer, the above prepared diazonium compound layer formation liquid D-5 was applied to the undercoat-layer-coated paper to form a diazonium compound layer with a deposition of 2.35 g/m$^2$ of the solid components of the liquid D-5 when dried.

After drying the diazonium compound layer, the above prepared coupler layer formation liquid C-5 was applied to the diazonium compound layer to form a coupler layer on the diazonium compound layer with a deposition of 3.7 g/m$^2$ of the solid components of the liquid C-5 when dried, whereby a thermosensitive coloring layer was formed on the high quality paper.

The thus prepared thermosensitive recording material was subjected to drying and calendering as in Example 1 so as to have a smoothness of 400 seconds in terms of Bekk's smoothness, whereby a diazo-type thermosensitive recording material No. 5 according to the present invention was prepared.

On this thermosensitive recording material, images were formed and were then fixed in the same manner as in Example 1.

The image density of the thus obtained images and the background density were measured by the Macbeth densitometer (RD-514). The results were that the image density was 1.07 and the background density was 0.09.

After this image fixing, the thermosensitive recording material was subjected to the same forced storage test as in Example 1 in which the recording material was allowed to stand at 40° C. under relative humidity of 90% for 24 hours. After this forced test, the background density was 0.23.

COMPARATIVE EXAMPLE 1

Example 1 was repeated except that the coupler layer formation liquid C-1 was replaced by a comparative coupler formation liquid CC-1 with the following formulation, whereby a comparative diazo-type thermosensitive recording material No. 1 was prepared.

| | Parts by Weight |
|---|---|
| Imidazole | 1.0 |
| Naphthol AS | 0.7 |
| Silica | 0.5 |
| Methylcellulose | 0.5 |
| Water | 19.3 |

The thus prepared comparative diazo-type thermosensitive recording material No. 1 was subjected to the same forced storage test as in Example 1. The results were as follows:

| | |
|---|---|
| Initial Image Density: | 1.05 |
| Initial Background Density: | 0.11 |
| Background Density after the Forced Storage Test: | 0.31 |

COMPARATIVE EXAMPLE 2

Example 2 was repeated except that the coupler layer formation liquid C-2 was replaced by a comparative coupler formation liquid CC-2 with the following formulation, whereby a comparative diazo-type thermosensitive recording material No. 2 was prepared.

| | Parts by Weight |
|---|---|
| Benzimidazole | 1.0 |
| N—stearylbenzamide | 1.0 |
| Naphthol AS | 0.7 |
| Silica | 0.5 |
| Methylcellulose | 0.5 |
| Water | 18.3 |

The thus prepared comparative diazo-type thermosensitive recording material No. 2 was subjected to the same forced storage test as in Example 1. The results were as follows:

| | |
|---|---|
| Initial Image Density: | 0.75 |
| Initial Background Density: | 0.10 |
| Background Density after the Forced Storage Test: | 0.16 |

COMPARATIVE EXAMPLE 3

Example 2 was repeated except that the coupler layer formation liquid C-2 was replaced by a comparative coupler formation liquid CC-3 with the following formulation, whereby a comparative diazo-type theremosensitive recording material No. 3 was prepared.

| | Parts by Weight |
|---|---|
| 2-methylbenzimidazole | 1.0 |
| N—stearylbenzamide | 1.0 |
| Naphthol AS | 0.7 |
| Silica | 0.5 |
| Methylcellulose | 0.5 |
| Water | 18.3 |

The thus prepared comparative diazo-type thermosensitive recording material No. 3 was subjected to the same forced storage test as in Example 1. The results were as follows:

| | |
|---|---|
| Initial Image Density: | 0.72 |
| Initial Background Density: | 0.09 |
| Background Density after the Forced Storage Test: | 0.15 |

The above results are summarized in the following table:

| | Imidazole Derivative | I.D B.F. | B.D B.F. | B.D A.F |
|---|---|---|---|---|
| Example 1 | 1-benzylbenzimidazole | 1.07 | 0.10 | 0.16 |
| 2 | 1-benzoylibenzimidazole | 1.12 | 0.09 | 0.14 |
| 3 | 1-chloro-2,5-dimethyl-benzimidazole | 1.13 | 0.10 | 0.15 |
| 4 | 1-phenylbenzimidazole | 1.10 | 0.09 | 0.14 |
| 5 | 1,2-dimethyl-benzimidazole | 1.07 | 0.09 | 0.23 |
| Comp. Ex. 1 | Imidazole | 1.05 | 0.11 | 0.31 |
| 2 | Benzimidazole | 0.75 | 0.10 | 0.16 |
| 3 | 2-methylbenzimidazole | 0.72 | 0.09 | 0.15 |

Note: In the above table, I.D. denotes Image Density, B.D., Background Density, B.F., Before the forced Storage Test, and A.F., After the Forced Storage Test.

As can be seen from the above results, the diazo-type thermosensitive recording material according to the present invention is improved with respect to preservability and is capable of providing higher image density as compared with the conventional thermosensitive recording materials.

What is claimed is:

1. A diazo-type thermosensitive recording material comprising a support material, and at least two layers formed thereon, one of said layers being a diazonium compound layer comprising at least a diazonium compound, and another of said layers being a coupler layer comprising at least a coupler capable of reacting with said diazonium compound to form a dye, and a benzimidazole derivative having a substituent at the 1-position thereof.

2. A diazo-type thermosensitive recording material as claimed in claim 1, wherein said substituent is selected from the group consisting of an alkyl group, an aryl group, an aralkyl group, halogen, a cyano group, an acyl group, an amino group, a monoalkylamino group, a dialkylamino group, an anilino group, a monoalkylanilino group and a dialkylanilino group.

3. A diazo-type thermosensitive recording material as claimed in claim 2, wherein the amount of said benzimidazole derivative in said coupler layer is in the range of 0.5 to 5 parts by weight with respect to one part by weight of said coupler.

4. A diazo-type thermosensitive recording material as claimed in claim 1, wherein the amount of said benzimidazole derivative in said coupler layer is in the range of 0.5 to 5 parts by weight with respect to one part by weight of said coupler.

5. A diazo-type thermosensitive recording material as claimed in claim 1, wherein said benzimidazole derivative is selected from the group consisting of 1-methylbenzimidazole, 1-phenylbenzimidazole, 1-benzylbenzimidazole, 1,2-dimethylbenzimidazole, 1-p-tolyl-benzimidazole, 1-benzoylbenzimidazole, 1-methyl-4,5,7-trichlorobenzimidazole, 1-phenyl-6-bromobenzimidazole, 1-ethyl-2-methylbenzimidazole, 1,2-dimethyl-4,5,7-trichlorobenzimidazole, 1-phenyl-2-methyl-6-chlorobenzimidazole, 1-ethyl-2-methyl-4,5,7-trichlorobenzimidazole, 1-ethyl-4,5,6,7-tetrachlorobenzimidazole, 1-propyl-2-ethylbenzimidazole, 1,5-dimethylbenzimidazole, 1-ethyl-2,5-dimethylbenzimidazole, 1-p-tolyl-2,5-dimethylbenzimidazole, 1-benzyl-2,5-dimethylbenzimidazole, 1-chloro-2,5-dimethylbenzimidazole, 1,4,6-trimethylbenzimidazole, 1-p-toluidino-2-ethyl-6-methylbenzimidazole, 1-methyl-2-phenylbenzimidazole, 1-ethyl-2-phenylbenzimidazole, 1,2-diphenylbenzimidazole, 1-benzyl-2-phenylbenzimidazole, 1-cyano-2-phenylbenzimidazole, 1-methyl-2-phenyl-5-nitrobenzimidazole, 1-p-tolyl-2-phenyl-5-methylbenzimidazole, and 1,5-dimethyl-2-phenylbenzimidazole.

6. A diazo-type thermosensitive recording material as claimed in claim 1, in which said benzimidazole derivative is selected from the group consisting of 1-benzylbenzimidazole, 1-benzoylbenzimidazole, 1-chloro-2,5-dimethylbenzimidazole, 1-phenylbenzimidazole and 1,2-dimethylbenzimidazole.

* * * * *